US011795627B2

(12) United States Patent
Alsop et al.

(10) Patent No.: US 11,795,627 B2
(45) Date of Patent: Oct. 24, 2023

(54) HIGH-RESILIENT SPECIAL TRACKWORK RAIL FASTENER

(71) Applicant: L B. Foster Company, Pittsburgh, PA (US)

(72) Inventors: Robert L. Alsop, Rossville, GA (US); Sheenfar S Fong, Suwanee, GA (US); Korhan Ciloglu, Pittsburgh, PA (US)

(73) Assignee: L. B. Foster Company, Pittsburgh, PA (US)

( * ) Notice: Subject to any disclaimer, the term of this patent is extended or adjusted under 35 U.S.C. 154(b) by 351 days.

(21) Appl. No.: 17/087,217

(22) Filed: Nov. 2, 2020

(65) Prior Publication Data

US 2022/0136177 A1 May 5, 2022

(51) Int. Cl.
*E01B 9/42* (2006.01)
*E01B 9/68* (2006.01)

(52) U.S. Cl.
CPC ..... *E01B 9/42* (2013.01); *E01B 9/681* (2013.01)

(58) Field of Classification Search
CPC ..... E01B 9/02; E01B 9/42; E01B 9/54; E01B 9/58; E01B 9/60; E01B 9/62; E01B 9/681
See application file for complete search history.

(56) References Cited

FOREIGN PATENT DOCUMENTS

WO WO-2019195887 A1 * 10/2019 ..... E01B 9/42

* cited by examiner

*Primary Examiner* — Robert J McCarry, Jr.
(74) *Attorney, Agent, or Firm* — Paul D. Bangor, Jr., Esquire; Clark Hill PLC

(57) ABSTRACT

A direct fixation fastener comprising: a top plate; a bottom plate made of metal structural channel providing two spaced-apart side walls, wherein the bottom plate has a first end and a second end and wherein each of the first and second ends terminate in a first flat edge section and a second flat edge section, respectively, without spaced-apart side walls; first and second angle bars, wherein the first angle bar is attached to the first flat edge section and the second angle bar is attached to the second flat edge section; and an elastomeric layer disposed between the top plate and the bottom plate, between the top plate and angle bars and between the angle bars and the spaced-apart side walls.

22 Claims, 9 Drawing Sheets

HIGH-RESILIENT SPECIAL TRACKWORK RAIL FASTENER

FIELD OF THE DISCLOSURE

The present disclosure is related to the field of direct fixation fasteners designed to attenuate wheel impact from train wheels while providing structural stability to railroad track and electrical insulation between the rail mainly in passenger rail transit applications.

BACKGROUND

Design of direct fixation fasteners could involve different design approaches. One of them involves bonding two steel or cast ductile iron plates bonded with a vulcanized rubber layer in between, designed to provide certain amount of resilience to the assembly in the vertical and horizontal directions. Another design approach is to use a non-bonded elastomer pad between the top metallic plate the bottom one, providing resilience in the vertical direction. All designs incorporate different elements to maintain structural stability and electrical insulation. Concrete blocks held in rubber boots supported on elastomeric pads are another form of direct fixation.

Direct fixation fastener plates may also be categorized based on their location of utilization. For example, installation in continuous tangent track involves repeating the same design in a linear continuous pattern. Design features such as location of hold-down clips for rail on tangent track fasteners are fixed and variability is not desired.

However, such continuity is not available in special trackwork areas where train tracks merge or cross. Special plate designs are needed in these areas to accommodate track geometry. Special trackwork plates are usually designed in different lengths, while holding their width constant, where the width is defined by the dimension aligned with the rail direction. Furthermore, special trackwork plates require flexibility with hold-down clip position, which could be unique from plate to plate due to varying track geometry. The need for geometric variation creates a challenge for manufacturing as multiple tools would be required to accommodate different lengths and clip attachment locations, and costs are higher than fixed designs.

Another way to categorize direct fixation fasteners is based their resilience (or stiffness), which stands for the amount deflection a fastener displays under unit load (Kips). While there is no absolute definition, fasteners having ~150 kip/in stiffness under vertical loading would be considered as fasteners with "standard stiffness" in North America. Fasteners having a stiffness between 40 kip/in and 80 kip/in would be considered as "high-resilient". High resilient fasteners are more challenging to design because higher deflections tend to create higher stresses in the product and designs must incorporate features to keep such stresses in check while providing the desired stiffness. Higher resilience is a desired feature for noise and vibration mitigation.

The present disclosure is directed to a novel and unique design approach for a high resilient special trackwork fastener plate, to be used in special trackwork areas mainly in passenger railroads. It aims to reduce manufacturing complexity and cost while maintaining desired high resilience and geometrical adjustability. The present disclosure is thus directed to a novel and unique design for a high resilient special trackwork direct fixation fastener having slotted holes in the top plate, and that uses off-the-shelf, commonly available structural shapes for making the top and bottom plates provides the desired ability of making such special trackwork direct fixation fastener in various lengths as needed.

BRIEF SUMMARY OF THE DISCLOSURE

Many other variations are possible with the present disclosure, and those and other teachings, variations, and advantages of the present disclosure will become apparent from the description and figures of the disclosure.

One aspect of a preferred embodiment of the present disclosure comprises a direct fixation fastener comprising: a top plate; a bottom plate made of metal structural channel providing two spaced-apart side walls, wherein the bottom plate has a first end and a second end and wherein each of the first and second ends terminate in a first flat edge section and a second flat edge section, respectively, without spaced-apart side walls; first and second angle bars, wherein the first angle bar is attached to the first flat edge section and the second angle bar is attached to the second flat edge section; and an elastomeric layer disposed between the top plate and the bottom plate, between the top plate and angle bars and between the angle bars and the spaced-apart side walls.

In another aspect of a preferred direct fixation fastener of the present disclosure, the top plate defines one or more key-shaped slotted openings.

In yet another aspect of a preferred direct fixation fastener of the present disclosure, each of the first and second angle bars is disposed perpendicularly to the spaced-apart side walls.

In another aspect of a preferred direct fixation fastener of the present disclosure, the bottom plate and first and second flat edge sections are machined out of a single steel C-channel.

In a further aspect of a preferred direct fixation fastener of the present disclosure, the spaced-apart side walls are disposed vertically with respect to a bottom surface of the bottom plate.

In another aspect of a preferred direct fixation fastener of the present disclosure, the bottom plate defines a central opening.

In yet another aspect of a preferred direct fixation fastener of the present disclosure, the elastomeric layer has a hardness in the range of 55 to 65 Shore A durometer wherein the elastomeric layer has a hardness in the range of 55 to 65 Shore A durometer around the first and second angle bars, and wherein a remainder of the elastomeric layer has a hardness in the range of 45 to 55 Shore A durometer.

In another aspect of a preferred direct fixation fastener of the present disclosure, each of the first and second angle bars comprises A36 L 3×2½×⅜.

In an additional aspect of a preferred direct fixation fastener of the present disclosure, the first angle bar is welded to the first flat edge section and the second angle bar is welded to the second flat edge section.

In another aspect of a preferred direct fixation fastener of the present disclosure, the elastomeric layer has at least one opening under the top plate to provide the desired stiffness under vertical loading.

In yet another aspect of a preferred direct fixation fastener of the present disclosure, the elastomeric layer comprises rubber.

In a further aspect of a preferred direct fixation fastener of the present disclosure, the elastomeric layer defines one or more stiffness relief holes.

In another aspect of a preferred direct fixation fastener of the present disclosure, the elastomeric layer has a hardness in the range of 45 to 55 Shore A durometer.

In yet another aspect of a preferred direct fixation fastener of the present disclosure, the elastomeric layer has a hardness in the range of 55 to 65 Shore A durometer.

In a further aspect of a preferred direct fixation fastener of the present disclosure, the elastomeric layer covers the space between the top plate and the first flat edge up to the first angle bar and wherein the elastomeric layer covers the space between the top plate and the second flat edge up to the second angle bar.

In another aspect of a preferred direct fixation fastener of the present disclosure, the elastomeric layer covers the space between the top plate and the first flat edge up to and surrounding the first angle bar in-whole or in-part and wherein the elastomeric layer covers the space between the top plate and the second flat edge up to and surrounding the second angle bar in-whole or in-part.

In yet a further aspect of a preferred direct fixation fastener of the present disclosure, the bottom plate comprises C-Channel A36 C10×20.

In another aspect of a preferred direct fixation fastener of the present disclosure, the top plate defines one or more slotted openings.

In yet another aspect of a preferred direct fixation fastener of the present disclosure, the first angle bar and the first flat edge section to which it is attached define one or more holes and wherein the second angle bar and the second flat edge section to which it is attached define one or more holes.

In another aspect of a preferred direct fixation fastener of the present disclosure, the elastomeric layer defines one or more dimples, wherein each dimple forms an elongated trench running part way or the full way across elastomeric layer.

In a further aspect of a preferred direct fixation fastener of the present disclosure, the elastomeric layer has a hardness of about 62 Shore A durometer.

In another aspect of a preferred direct fixation fastener of the present disclosure, the elastomeric layer is disposed between first and second sides of the top plate and the respective opposing side wall of the bottom plate.

In yet another aspect of a preferred direct fixation fastener of the present disclosure, the elastomeric layer is disposed between a bottom surface of the top plate and a top surface of the bottom plate and wherein a portion the elastomeric layer partially fills the central opening around a perimeter of the central opening and the portion of the elastomeric layer disposed in the central opening has a bottom surface that is flush is with a bottom surface of the bottom plate.

BRIEF DESCRIPTION OF THE DRAWINGS

The present disclosure is illustrated by way of example and not limitation in the figures of the accompanying drawings, in which.

DETAILED DESCRIPTION OF PREFERRED EMBODIMENTS

Figure 1:
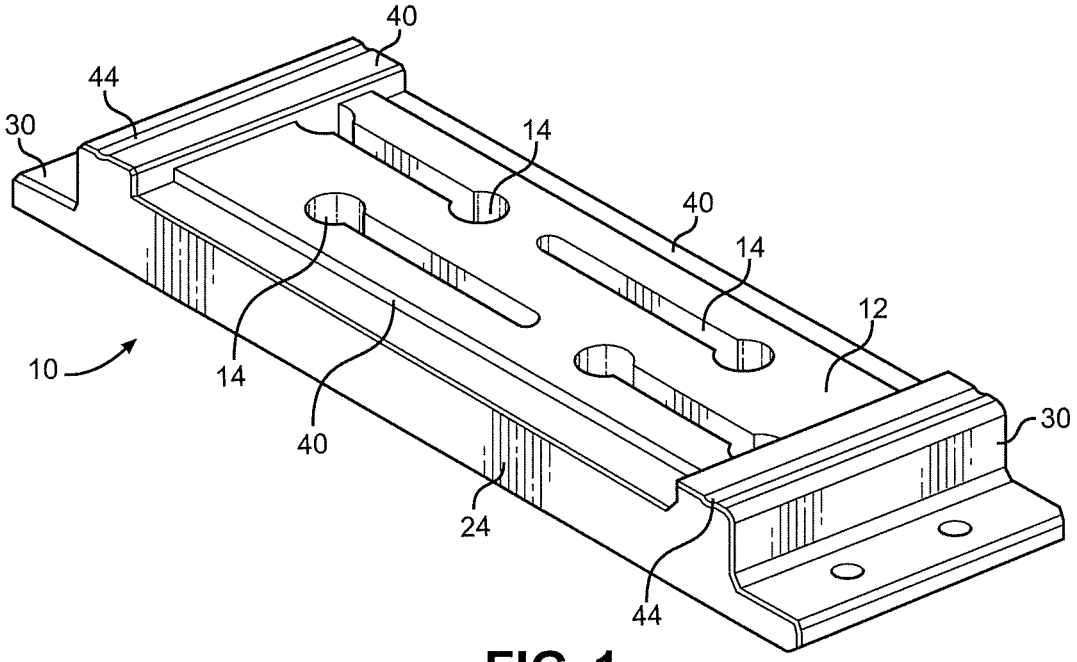
FIG. 1 is a top isometric view of a preferred embodiment of a high resilient special trackwork direct fixation fastener of the present disclosure.

The following description, taken in conjunction with the referenced drawings, is presented to enable one of ordinary skill in the art to make and use the disclosure and to incorporate it in the context of particular applications. Various modifications, as well as a variety of uses in different applications, will be readily apparent to those skilled in the art, and the general principles, defined herein, may be applied to a wide range of aspects. The present disclosure is not intended to be limited to the aspects disclosed herein. Instead, it is to be afforded the widest scope consistent with the disclosed aspects.

It is to be understood that the descriptions of the present disclosure have been simplified to illustrate elements that are relevant for a clear understanding of the present disclosure, while eliminating, for purposes of clarity, other elements that may be well known. Those of ordinary skill in the art will recognize that other elements are desirable and/or required in order to implement the present disclosure. However, because such elements are well known in the art, and because they do not facilitate a better understanding of the present disclosure, a discussion of such elements is not provided herein. Additionally, it is to be understood that the present disclosure is not limited to the embodiments described herein but encompasses any and all embodiments within the scope of the description and the following claims.

FIGS. 1-17 illustrate several preferred embodiments of a high-resilient special trackwork direct fixation fastener 10 of the present disclosure that comprises a metal top plate 12 having slotted openings 14 which may be rectangularly shaped, key-shaped or otherwise shaped as needed, a metal bottom plate 20 with at least two vertical side walls or protrusions 24, two angle sections 30 attached to bottom plate 20, and a rubber or elastomeric layer 40 separating top plate 12 from all other metal parts including bottom plate 20 and its vertical sides 24 and the angle sections 30.

Preferably, the bottom plate 20 is made of metal structural channel such as machined steel C-channel bar 22 having vertical sides 24 and flat edge sections 21 where the spaced-apart side walls 24 have been machined away. Bottom plate 20 also preferably defines at least one opening 25 which preferably may be centered in the bottom plate 20. More preferably, bottom plate 20 is made of C-Channel A36 C10×20. Bottom plate 20 may also comprise metal structural channel such as machined steel U-channel bar.

Preferably, top plate 12 is fabricated out of flat A36 grade structural steel and defines key-shaped slotted openings 14 for clip housing attachment at various positions on top plate 12. Also, preferably, top plate 12 may be left flat without holes or openings 14 for welded clip housing attachment in the field. Further, top plate 12 is preferably 1.25 inches thick Each of the angle bars or sections 30 are preferably attached to the bottom plate 20 on the flat edge section 21 thereof where the vertical sides 24 have been cut or machined away. Preferably, each angle section 30 is attached to bottom plate 20, preferably by welding. Angle sections or bars 30 are preferably made of commercially available angle-section A36 L 3×2½×⅜. Preferably, holes 32 are drilled through the side of each angle bar 30 and the flat edge section 21 to which it is attached for mounting the direct fixation fastener to rail road ties or other rail road track foundations with fasteners such as bolts, spikes or screws (not shown).

Figure 2:
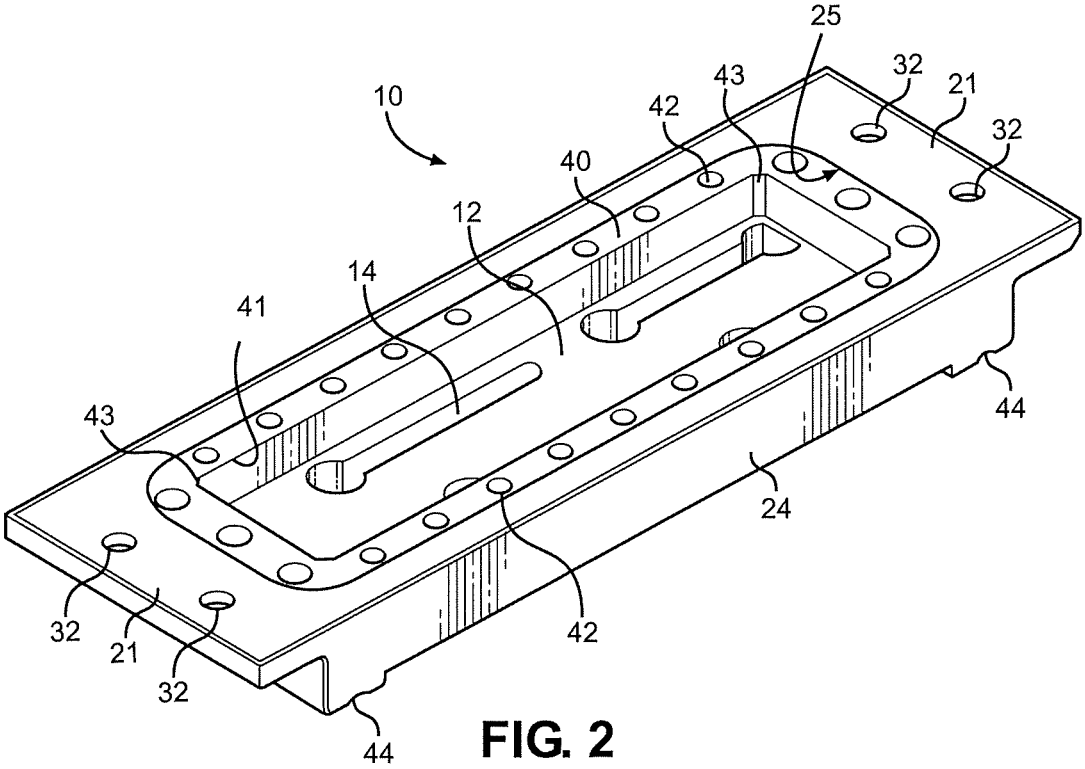
FIG. 2 is a bottom isometric view of the high resilient special trackwork direct fixation fastener of FIG. 1.
Figure 3:
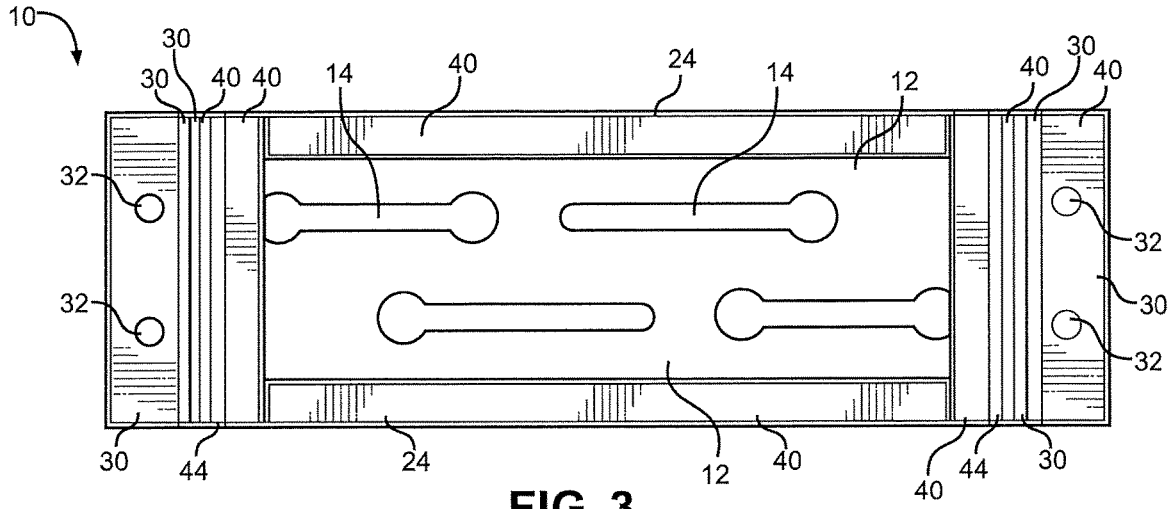
FIG. 3 is a top plan view of the high resilient special trackwork direct fixation fastener of FIG. 1.
Figure 4:
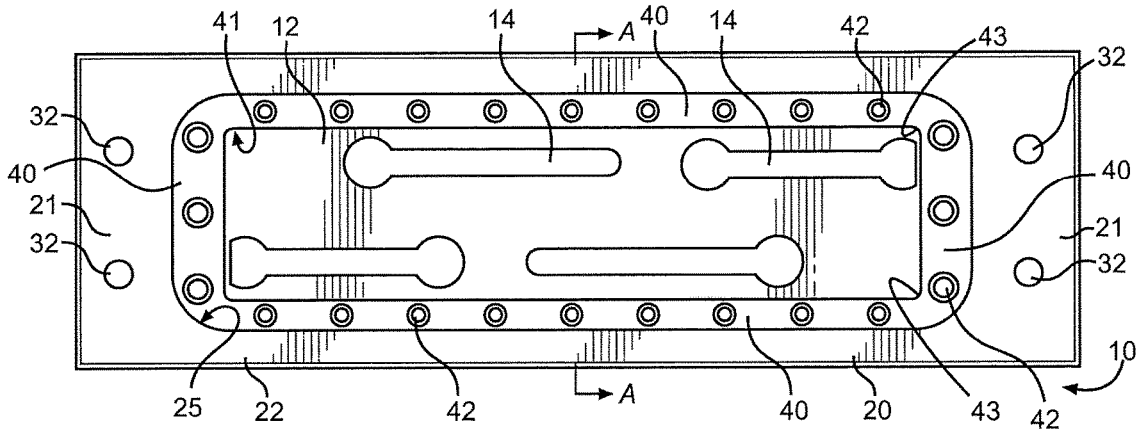
FIG. 4 is a bottom plan view of the high resilient special trackwork direct fixation fastener of FIG. 1.
Figure 5:
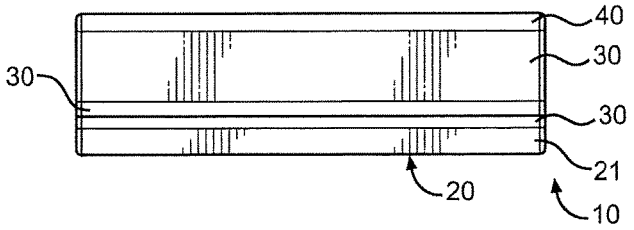
FIG. 5 shows a front elevational view, which is the same as a back elevational view, of the high resilient special trackwork direct fixation fastener of FIG. 1.
Figure 6:
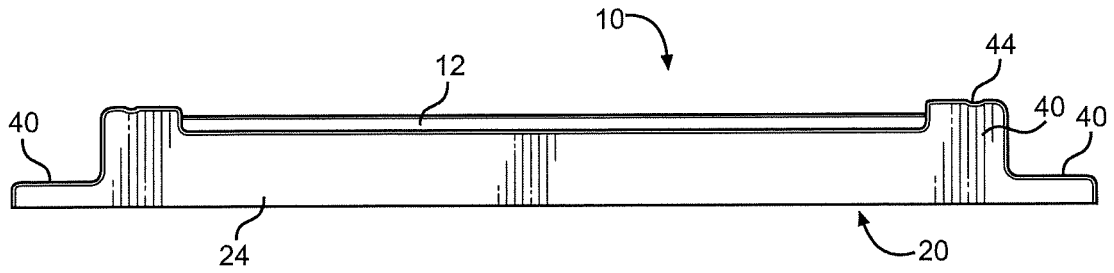
FIG. 6 shows a left-side elevational view, which is the same as a right-side elevational view, of the high resilient special trackwork direct fixation fastener of FIG. 1.
Figure 7:
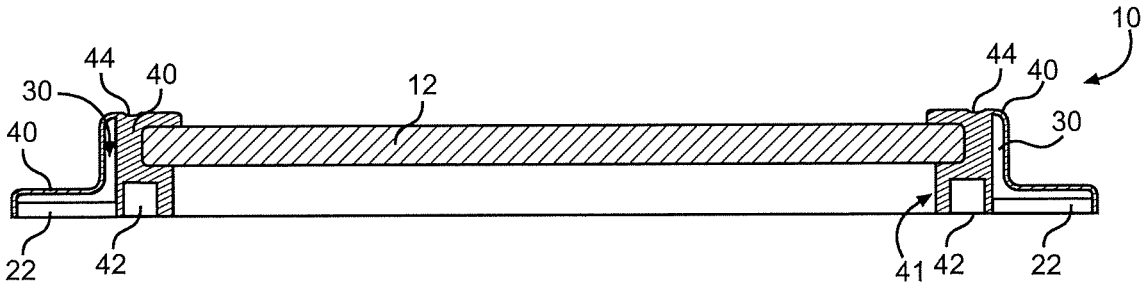
FIG. 7 is a side cross-sectional view of the high resilient special trackwork direct fixation fastener of FIG. 1.
Figure 8:
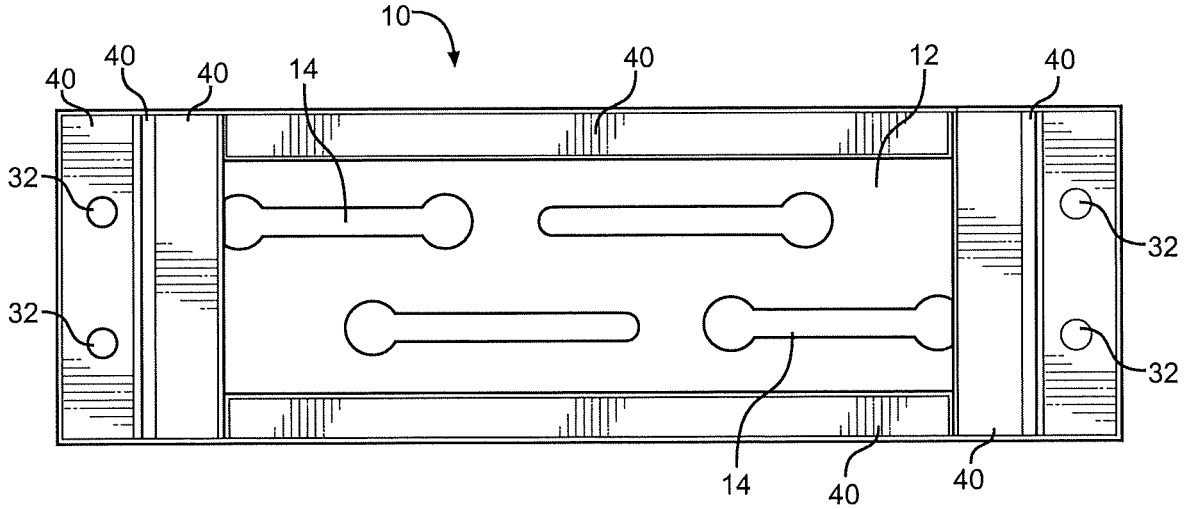
FIG. 8 is a top plan view of another preferred embodiment of a high resilient special trackwork direct fixation fastener of the present disclosure.
Figure 9:
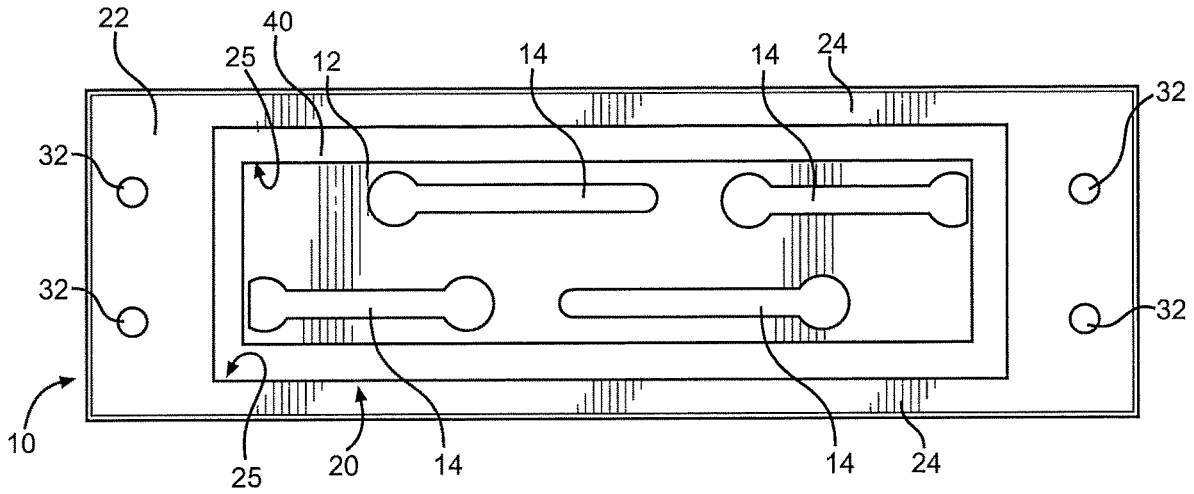
FIG. 9 is a bottom isometric view of the high resilient special trackwork direct fixation fastener of FIG. 8.
Figure 10:
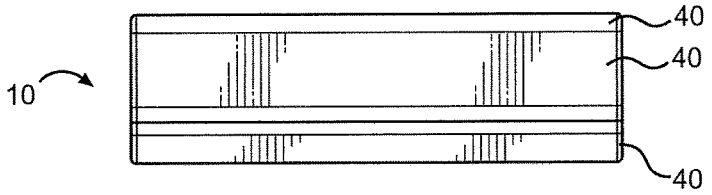
FIG. 10 shows a front elevational view, which is the same as a back elevational view, of the high resilient special trackwork direct fixation fastener of FIG. 8.
Figure 11:
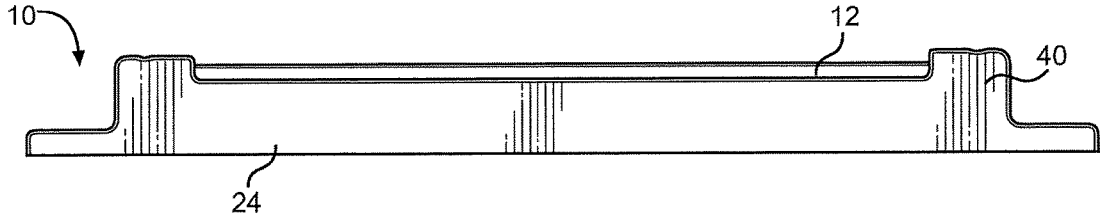
FIG. 11 shows a left-side elevational view, which is the same as a right-side elevational view, of the high resilient special trackwork direct fixation fastener of FIG. 8.
Figure 12:
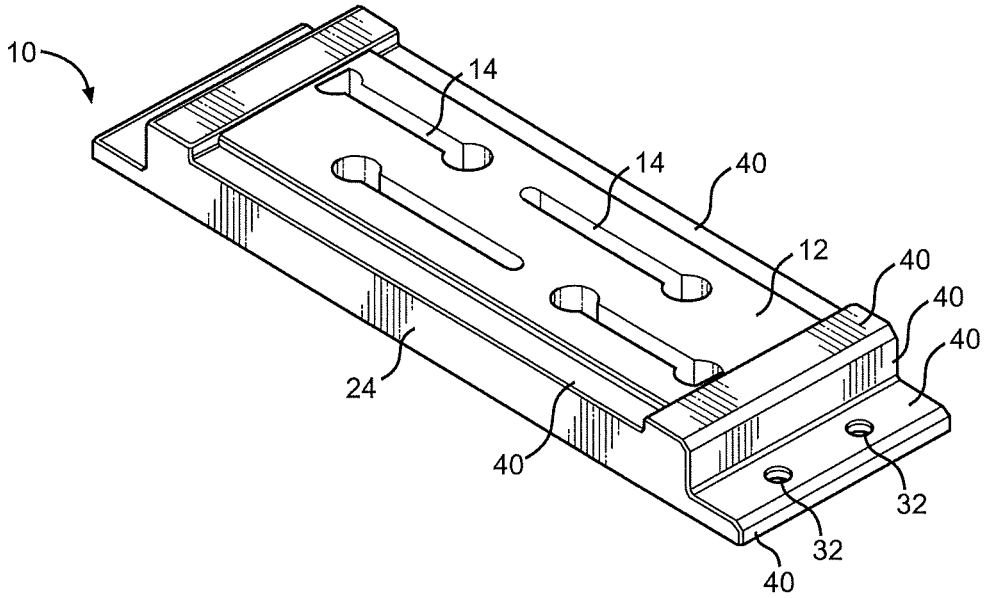
FIG. 12 shows a top isometric view of the high resilient special trackwork direct fixation fastener of FIG. 8.
Figure 13:
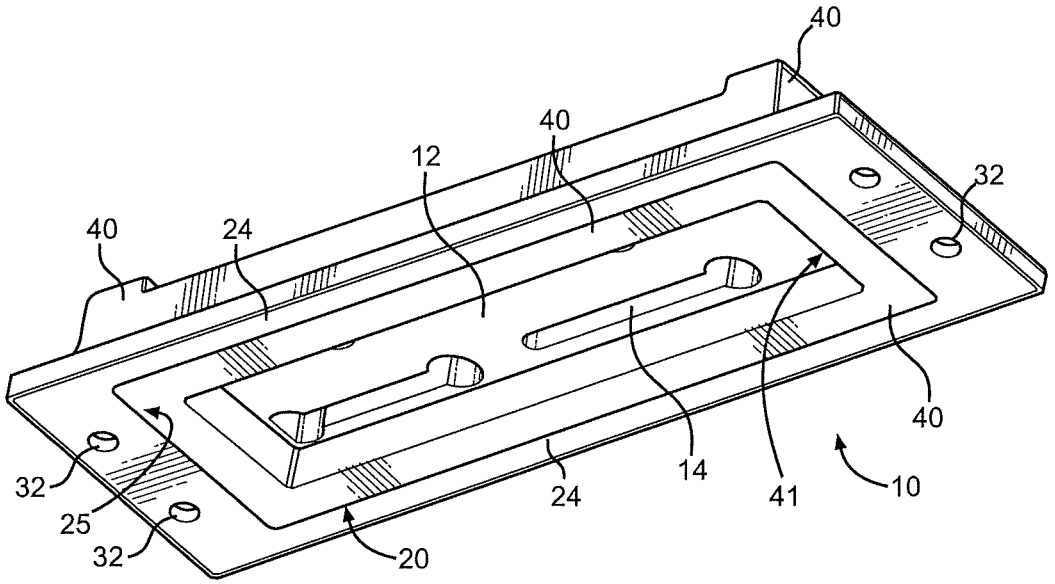
FIG. 13 shows a bottom isometric view of the high resilient special trackwork direct fixation fastener of FIG. 8.
Figure 14:
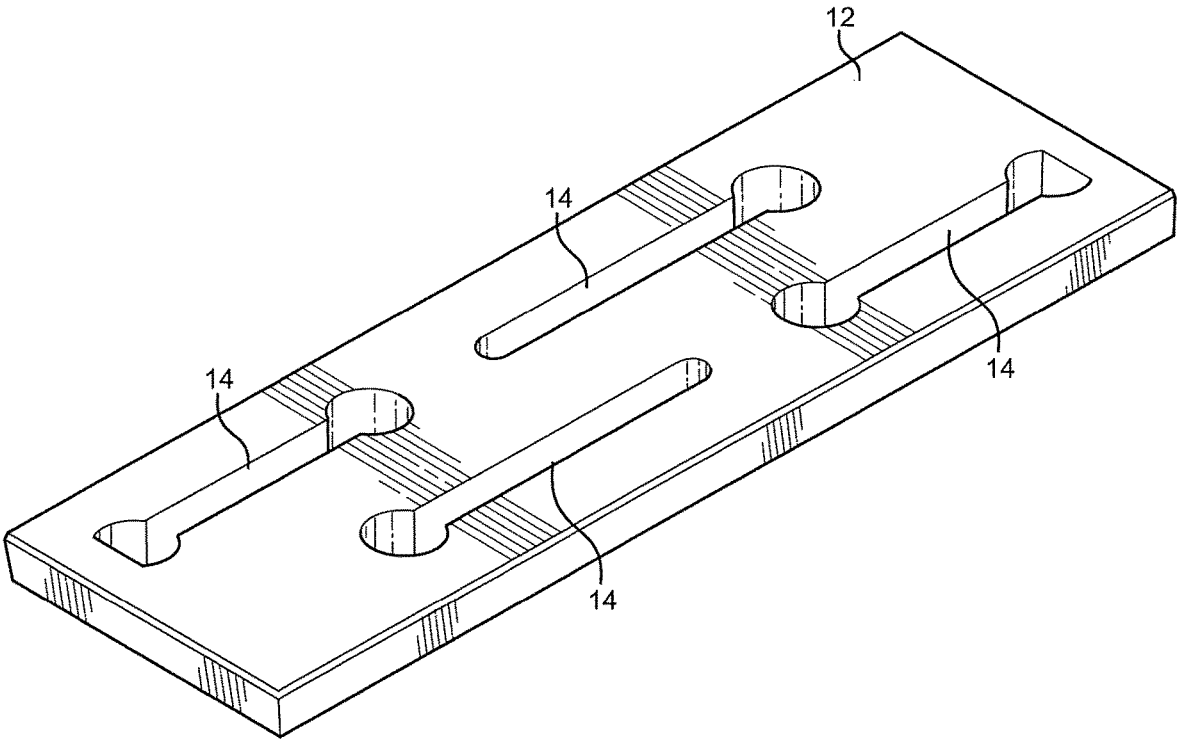
FIG. 14 shows a top isometric view of a preferred embodiment of a top plate for a high resilient special trackwork direct fixation fastener of the present disclosure.
Figure 15:
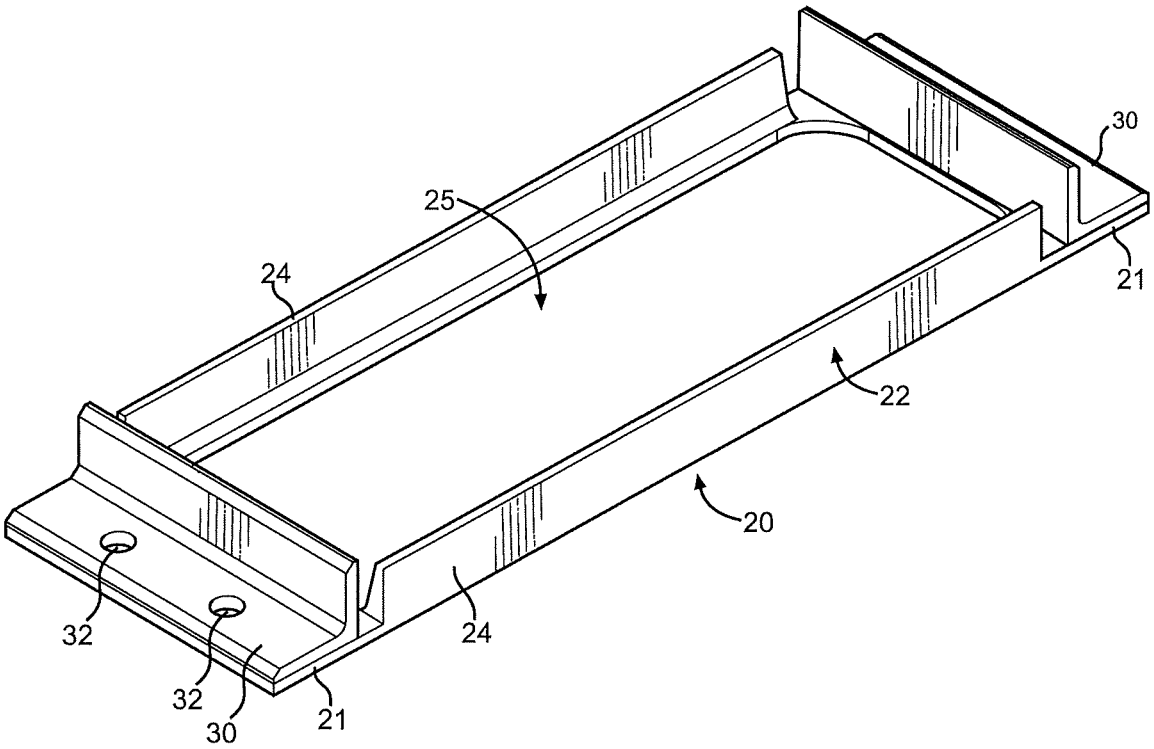
FIG. 15 shows a top isometric view of a preferred embodiment of a bottom plate with attached angle bars for a high resilient special trackwork direct fixation fastener of the present disclosure.
Figure 16:
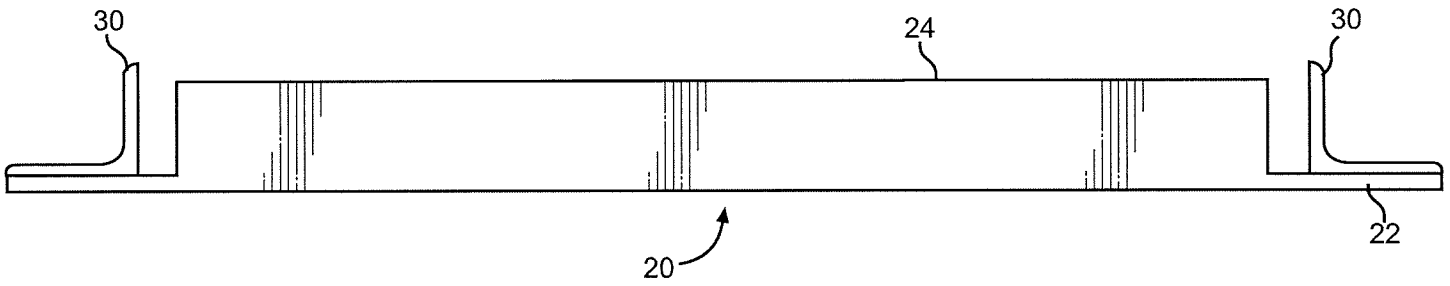
FIG. 16 shows a left-side elevational view, which is the same as a right-side elevational view, of the bottom plate with attached angle bars of FIG. 15.
Figure 17:
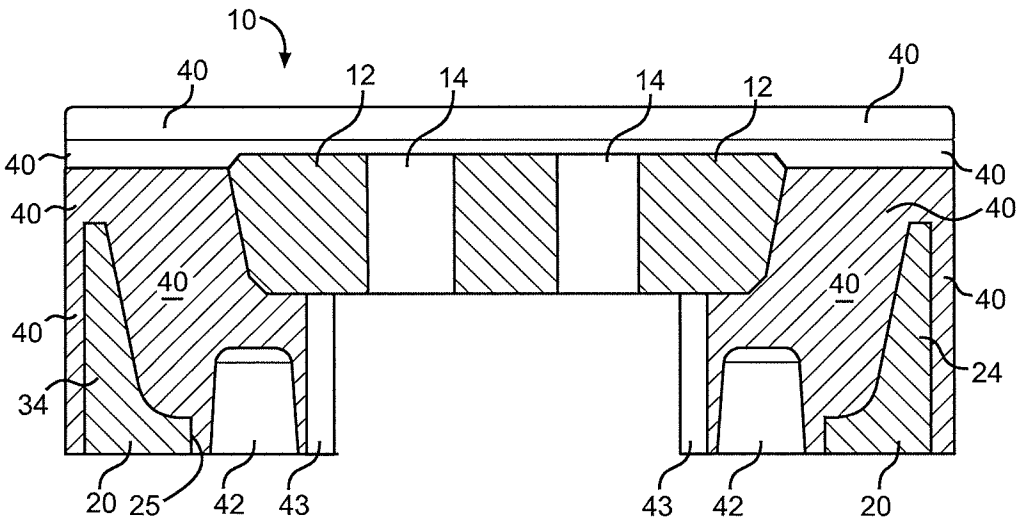
FIG. 17 shows a cross-sectional view of the high resilient special trackwork direct fixation fastener along Line A-A of FIG. 4.

Preferably, the elastomeric layer 40 is made of rubber and has at least one large opening 41 under the top plate 12 to provide the desired stiffness under vertical loading. The inside corners 43 of in opening 41 of elastomeric layer 40 preferably are beveled or radiused as shown in FIGS. 2, 4 and 17. Elastomeric layer 40 has at least one, and preferably multiple, circular relief holes 42 as needed to provide stiffness adjustment through the manufacturing process to the high-resilient special trackwork direct fixation fastener 10 of the present disclosure. Preferably, elastomeric layer 40 is bonded to the assembly of top plate 12 and bottom plate 20 using vulcanizing process. Preferably, elastomeric layer 40 has a hardness in the range of 45 to 65 Shore A durometer. More preferably, elastomeric layer 40 has a hardness of about 62 Shore A durometer. As shown in FIGS. 1, 3, 6 and 7, elastomeric layer 40 also preferably may define one or more dimples 44 which may be in the Bonn of an elongated trench running part way or the full way across elastomeric layer 40 as shown in FIG. 1.

It should be understood that while the present disclosure has been described herein in terms of specific embodiments set forth in detail, such embodiments are presented by way of illustration of the general principles of the present disclosure, and the present disclosure is not necessarily limited thereto. Certain modifications and variations in any given material, process step or chemical formula will be readily apparent to those skilled in the art without departing from the true spirit and scope of the present disclosure, and all such modifications and variations should be considered within the scope of the claims that follow.

What is claimed is:

1. A direct fixation fastener comprising:

a top plate;

a bottom plate made of metal structural channel providing two spaced-apart side walls, wherein the bottom plate has a first end and a second end, wherein the bottom plate defines a central opening and wherein each of the first and second ends terminates in a first flat edge section and a second flat edge section, respectively, without spaced-apart side walls;

first and second angle bars, wherein the first angle bar is attached to the first flat edge section and the second angle bar is attached to the second flat edge section; and an elastomeric layer disposed between the top plate and the bottom plate, between the top plate and angle bars and between the angle bars and the spaced-apart side walls.

2. The direct fixation fastener of claim 1 wherein the top plate defines one or more key-shaped slotted openings.

3. The direct fixation fastener of claim 1 wherein each of the first and second angle bars is disposed perpendicularly to the spaced-apart side walls.

4. The direct fixation fastener of claim 1 wherein the bottom plate and first and second flat edge sections are machined out of a single steel C-channel.

5. The direct fixation fastener of claim 1 wherein the spaced-apart side walls are disposed vertically with respect to a bottom surface of the bottom plate.

6. The direct fixation fastener of claim 1 wherein the elastomeric layer has a hardness in the range of 55 to 65 Shore A durometer wherein the elastomeric layer has a hardness in the range of 55 to 65 Shore A durometer around the first and second angle bars, and wherein a remainder of the elastomeric layer has a hardness in the range of 45 to 55 Shore A durometer.

7. The direct fixation fastener of claim 1 wherein each of the first and second angle bars comprises L-shaped angle bars having dimensions 3"×2½"×⅜".

8. The direct fixation fastener of claim 1 wherein the first angle bar is welded to the first flat edge section and the second angle bar is welded to the second flat edge section.

9. The direct fixation fastener of claim 1 wherein the elastomeric layer comprises rubber.

10. The direct fixation fastener of claim 1 wherein the elastomeric layer defines one or more stiffness relief holes.

11. The direct fixation fastener of claim 1 wherein the elastomeric layer has a hardness in the range of 45 to 55 Shore A durometer.

12. The direct fixation fastener of claim 1 wherein the elastomeric layer has a hardness in the range of 55 to 65 Shore A clinometer.

13. The direct fixation fastener of claim 1 wherein the elastomeric layer covers the space between the top plate and the first flat edge up to the first angle bar and wherein the elastomeric layer covers the space between the top plate and the second flat edge up to the second angle bar.

14. The direct fixation fastener of claim 1 wherein the elastomeric layer covers the space between the top plate and the first flat edge up to and surrounding the first angle bar in-whole or in-part and wherein the elastomeric layer covers the space between the top plate and the second flat edge up to and surrounding the second angle bar in-whole or in-part.

15. The direct fixation fastener of claim 1 wherein the bottom plate comprises C-Channel 10"×20".

16. The direct fixation fastener of claim 1 wherein the top plate defines one or more slotted openings.

17. The direct fixation fastener of claim 1 wherein the first angle bar and the first flat edge section to which it is attached define one or more holes and wherein the second angle bar and the second flat edge section to which it is attached define one or more holes.

18. The direct fixation fastener of claim 1 wherein the elastomeric layer has a hardness of about 62 Shore A durometer.

19. The direct fixation fastener of claim 1 wherein the elastomeric layer is disposed between first and second sides of the top plate and the respective opposing side wall of the bottom plate.

20. The direct fixation fastener of claim 1 wherein the elastomeric layer is disposed between a bottom surface of the top plate and a top surface of the bottom plate and wherein a portion the elastomeric layer partially fills the central opening around a perimeter of the central opening and the portion of the elastomeric layer disposed in the central opening has a bottom surface that is flush is with a bottom surface of the bottom plate.

21. A direct fixation fastener comprising:

a top plate;

a bottom plate made of metal structural channel providing two spaced-apart side walls, wherein the bottom plate has a first end and a second end and wherein each of the first and second ends terminates in a first flat edge section and a second flat edge section, respectively, without spaced-apart side walls;

first and second angle bars, wherein the first angle bar is attached to the first flat edge section and the second angle bar is attached to the second flat edge section; and an elastomeric layer disposed between the top plate and the bottom plate, between the top plate and angle bars and between the angle bars and the spaced-apart side walls;

wherein the elastomeric layer has at least one opening under the top plate to provide the desired stiffness under vertical loading.

22. A direct fixation fastener comprising:

a top plate;

a bottom plate made of metal structural channel providing two spaced-apart side walls, wherein the bottom plate has a first end and a second end and wherein each of the first and second ends terminates in a first flat edge section and a second flat edge section, respectively, without spaced-apart side walls;

first and second angle bars, wherein the first angle bar is attached to the first flat edge section and the second angle bar is attached to the second flat edge section; and an elastomeric layer disposed between the top plate and the bottom plate, between the top plate and angle bars and between the angle bars and the spaced-apart side walls; wherein the elastomeric layer defines one or more dimples, wherein each dimple forms an elongated trench running part way or the fall way across elastomeric layer.

* * * * *